US009753398B2

(12) United States Patent
Miura et al.

(10) Patent No.: US 9,753,398 B2
(45) Date of Patent: Sep. 5, 2017

(54) IMAGE FORMING APPARATUS AND CONTROL METHOD OF IMAGE FORMING APPARATUS TO REPLENISHMENT CONTROL OF TONER

(71) Applicant: CANON KABUSHIKI KAISHA, Tokyo (JP)

(72) Inventors: Shusuke Miura, Toride (JP); Jiro Shirakata, Chigasaki (JP); Takayuki Iikura, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/565,202

(22) Filed: Dec. 9, 2014

(65) Prior Publication Data

US 2015/0168869 A1 Jun. 18, 2015

(30) Foreign Application Priority Data

Dec. 17, 2013 (JP) ..... 2013-260380

(51) Int. Cl.
*G03G 15/08* (2006.01)
*G03G 15/00* (2006.01)

(52) U.S. Cl.
CPC ..... *G03G 15/0831* (2013.01); *G03G 15/556* (2013.01); *G03G 15/086* (2013.01)

(58) Field of Classification Search
CPC ..... G03G 15/556
USPC ..... 399/27
See application file for complete search history.

(56) References Cited

U.S. PATENT DOCUMENTS

| | | | | |
|---|---|---|---|---|
| 5,826,134 | A * | 10/1998 | Hino | |
| 7,395,002 | B2 * | 7/2008 | Funayama | |
| 8,000,615 | B2 * | 8/2011 | Mizuyama | |
| 2006/0158479 | A1 * | 7/2006 | Yamaguchi | |
| 2006/0263106 | A1 * | 11/2006 | Yamaguchi | 399/27 |
| 2013/0202319 | A1 * | 8/2013 | Komatsu | 399/27 |

FOREIGN PATENT DOCUMENTS

| | | | |
|---|---|---|---|
| JP | 4-304486 | A | 10/1992 |
| JP | 2000-181214 | A | 6/2000 |
| JP | 2006-91211 | A | 4/2006 |

* cited by examiner

*Primary Examiner* — Benjamin Schmitt
*Assistant Examiner* — Milton Gonzalez
(74) *Attorney, Agent, or Firm* — Canon USA, Inc. IP Division

(57) ABSTRACT

An image forming apparatus including: an image formation unit including an accumulation unit accumulating toner, and forms an image based on image data using the accumulated toner; a measurement unit measures toner density of an developer in the accumulation unit; a replenishment unit replenishes toner to the accumulation unit from an attached container; a first determination unit determines a first value based on the image data; a second determination unit determines a second value based on the measurement result of the measurement result; a third determination unit determines a third value by accumulating the second value; and a controller controls the replenishment unit based on the first value, the second value, and the third value, wherein in a case where the container has been replaced, the third determination unit changes the third value into a predetermined value before the difference is determined by the second determination unit.

18 Claims, 5 Drawing Sheets

IMAGE FORMING APPARATUS AND CONTROL METHOD OF IMAGE FORMING APPARATUS TO REPLENISHMENT CONTROL OF TONER

BACKGROUND OF THE INVENTION

Field of the Invention

The present invention relates to replenishment control of toner.

Description of the Related Art

An electrophotographic image forming apparatus develops an electrostatic latent image in a developing unit and forms a toner image in accordance with image data input in the image forming apparatus. In this image forming apparatus, since toner in the developing unit is consumed as the toner image is formed, a configuration to suitably replenish the developing unit with toner contained in a container that is detachably attached to the image forming apparatus has been proposed.

Further, since density of the toner image developed by the developing unit is changed depending on an amount of toner accumulated in the developing unit, the amount of toner replenished to the developing unit from the container is to be controlled with high accuracy.

Therefore, a related art image forming apparatus determines the amount of toner to be replenished such that the amount of toner in the developing unit becomes a target amount by predicting an amount of toner consumed from the developing unit (i.e., toner consumption) when a toner image is formed in accordance with image data. Here, since the toner consumption is a theoretical value determined by calculation, some errors exist between actual toner consumption actually consumed from the developing unit and the determined toner consumption described above. That is, there is a possibility that the amount of toner in the developing unit does not become the target amount even if the toner corresponding to the toner consumption determined as described above is replenished.

This is because the amount of toner replenished to the developing unit from the container fluctuates depending on the amount of toner contained in the container. That is, this is because the amount of toner replenished to the developing unit from the container by one replenishing operation decreases each time the replenishing operation of the toner to the developing unit from the container is performed.

Then, Japanese Patent Laid-Open No. 4-304486 discloses a toner replenishing device configured to correct an amount of toner to be replenished in accordance with toner consumption using a correction amount calculated in accordance with an amount of toner in the developing unit.

However, the toner replenishing device disclosed in Japanese Patent Laid-Open No. 4-304486 has an issue that the amount of toner in the developing unit is not able to be controlled to a target amount once the container is replaced. This is because the amount of toner replenished to the developing unit from the container in a single replenishing operation is changed once the container is replaced.

SUMMARY OF THE INVENTION

The present invention provides an image forming apparatus including: an image formation unit including an accumulation unit accumulating developer included in toner, and configured to form an image based on image data, by using the accumulated toner; a measurement unit configured to measure a toner density of the developer accumulated in the accumulation unit; an attaching portion to which a container is attached; a replenishment unit configured to replenish toner to the accumulation unit from the container; a first determination unit configured to determine a first value corresponding to an amount of toner consumed from the accumulation unit based on the image data; a second determination unit configured to determine a second value corresponding to a difference between a toner density measured by the measurement unit and a target toner density in the accumulation unit; a third determination unit configured to determine a third value by accumulating the second value; and a controller configured to control the replenishment unit based on the first value, the second value, and the third value, wherein in a case where the container attached to the attaching portion has been replaced, the third determination unit changes the third value into a predetermined value before the second determination unit newly determines the second value.

A method of an apparatus which includes an image formation unit including an accumulation unit accumulating toner, and configured to form an image in accordance with image data using the accumulated toner, a detection unit configured to detect an amount of the toner accumulated in the accumulation unit, an attaching portion to which a container containing the toner to be replenished to the accumulation unit is attached, and a replenishment unit configured to replenish toner to the accumulation unit from the container, the method including: determining a first value, wherein the first value being corresponded to an amount of toner consumed from the accumulation unit in a case where the image formation unit forms the image based on the image data; determining a second value, wherein the second value being corresponded to a difference between a toner density of the developer and a target toner density; controlling the replenishment unit based on the first value, the second value, and a cumulative value of the second value; and setting, in a case where the container has been replaced, the cumulative value as a predetermined value before the second value is newly determined.

Further features of the present invention will become apparent from the following description of exemplary embodiments with reference to the attached drawings.

DESCRIPTION OF THE EMBODIMENTS

Image Forming Apparatus

Figure 1:
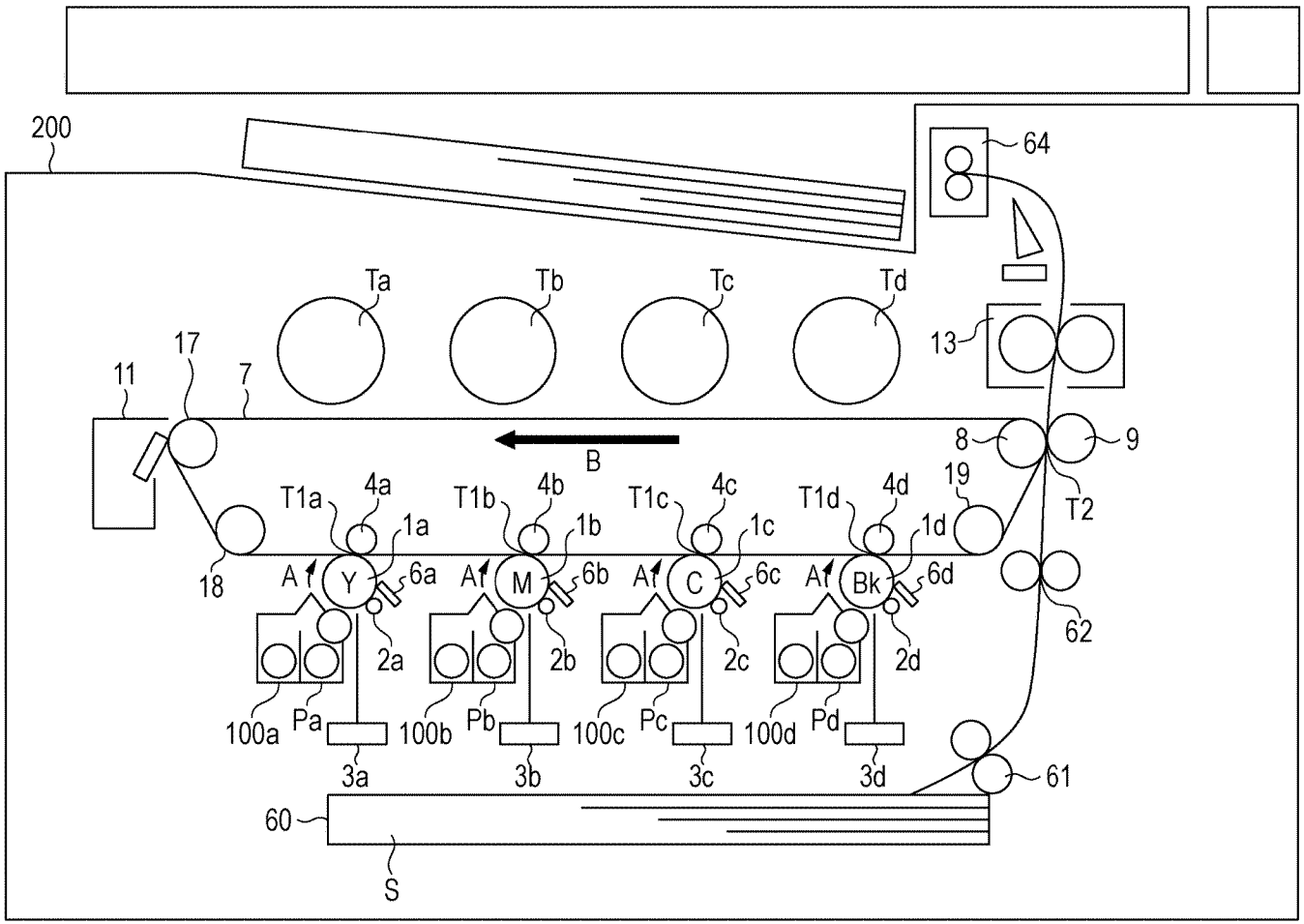
FIG. 1 is a schematic cross-sectional view of an image forming apparatus.

FIG. 1 is a schematic cross-sectional view of an image forming apparatus 200. In the image forming apparatus 200, four image forming units Pa, Pb, Pc and Pd each of which forms a toner image of each color component are arranged in a conveyance direction of an intermediate transfer belt 7. The image forming unit Pa forms a yellow toner image, the image forming unit Pb forms a magenta toner image, the image forming unit Pc forms a cyan toner image and the image forming unit Pd forms a black toner image.

Toner bottles Ta, Tb, Tc and Td are detachably attached to the image forming apparatus 200. The toner bottle Ta contains yellow toner, the toner bottle Tb contains magenta toner, the toner bottle Tc contains cyan toner and the toner bottle Td contains black toner. The toner bottles Ta, Tb, Tc and Td correspond to the containers which contain toner.

Since image forming units Pa, Pb, Pc and Pd are the same in configuration, the image forming units Pa, Pb, Pc and Pd will be referred to as an image forming unit P in the following description. Since the toner bottles Ta, Tb, Tc and Td are the same in configuration, the toner bottles Ta, Tb, Tc and Td will be referred to as a toner bottle T in the following description.

The image forming unit P is provided with a photoconductive drum 1, a charging unit 2 and a developing unit 100. The photoconductive drum 1 includes, on a surface of a cylindrical metal roller, a photosensitive layer which functions as a photosensitive member. The charging unit 2 charges the photoconductive drum 1. The developing unit 100 contains toner.

When an image formation operation is started, the photoconductive drum 1 is driven to rotate in a direction of an arrow A. After the charging unit 2 charges the photoconductive drum 1 uniformly, a laser exposure device 3 exposes the photoconductive drum 1 in accordance with image data. Thereby, an electrostatic latent image is formed on the photoconductive drum 1. The developing unit 100 develops the electrostatic latent image on the photoconductive drum 1 using toner and forms a toner image on the photoconductive drum 1.

Figure 2:
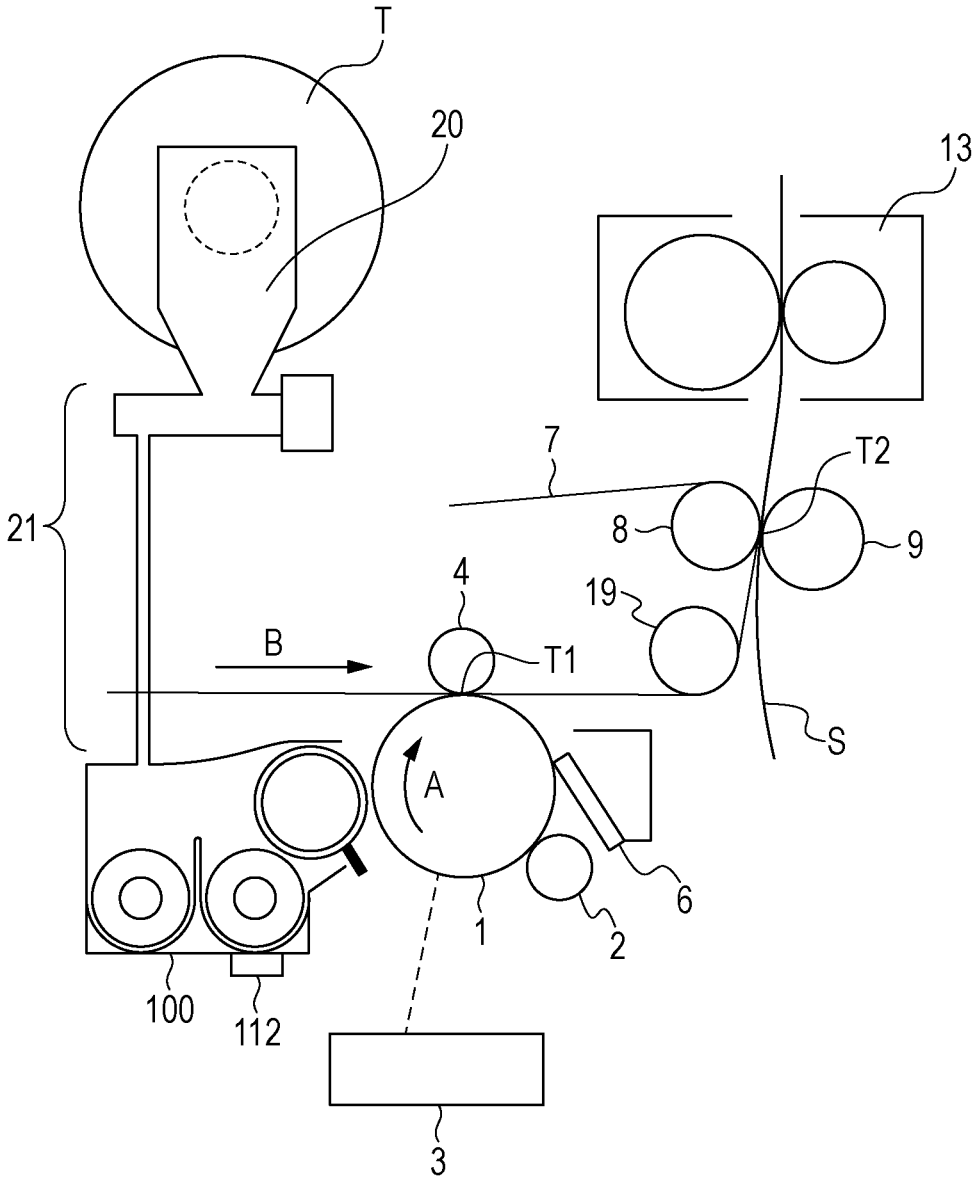
FIG. 2 is a schematic diagram of a main part of the image forming apparatus.

Here, as illustrated in FIG. 2, an inductance sensor 112 which detects an amount of toner accumulated in the developing unit 100 is provided in the developing unit 100. In particular, the inductance sensor 112 detects magnetic permeability of the developer contained in the developing unit 100 and outputs a signal in accordance with a ratio of toner in the developer. In accordance with the output signal of the inductance sensor 112, a controller 500 (FIG. 3) detects an amount of toner contained in the developer contained in the developing unit 100 which is an accumulation unit in which the developer is accumulated.

Figure 3:
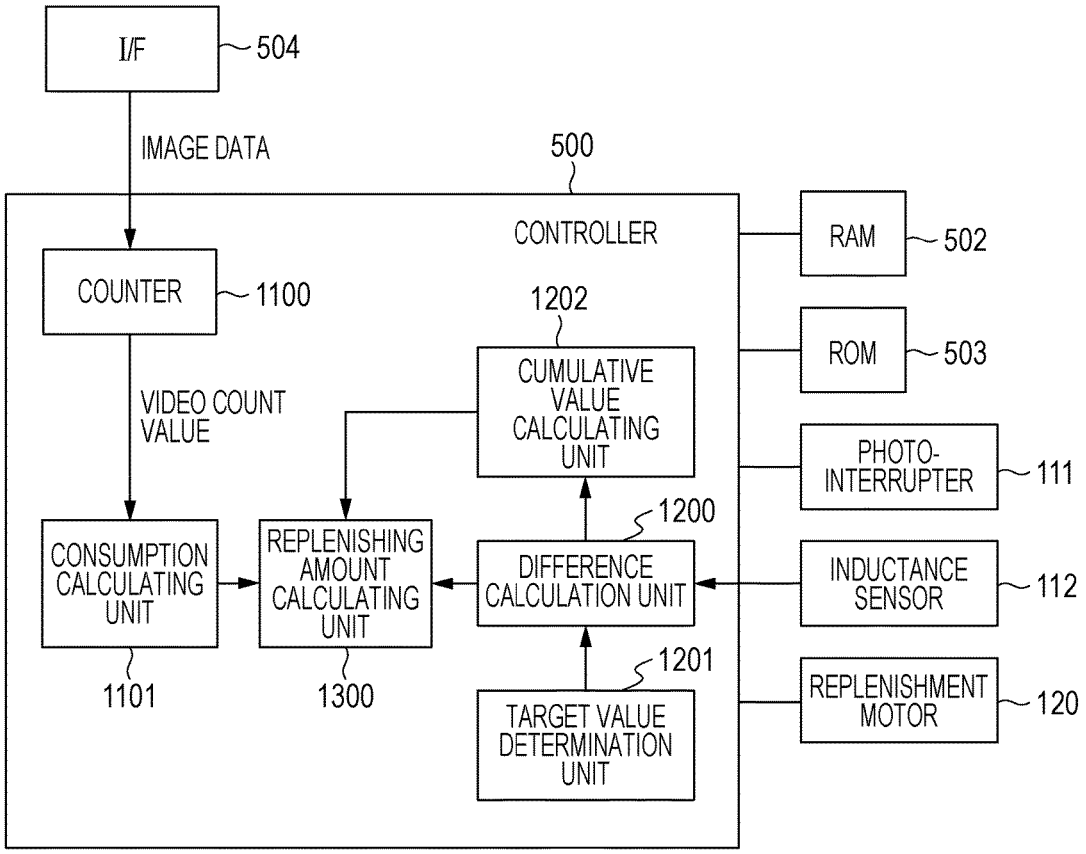
FIG. 3 is a block diagram of an electrical configuration related to toner replenishment of the image forming apparatus.

The developer contained in the developing unit 100 includes a magnetic career and a magnetic toner. Therefore, when a ratio of the toner in the developer (hereafter, referred to as a toner density in the developing unit) increases, the ratio of the career in the developer decreases and then an output value of the inductance sensor 112 decreases. On the other hand, since the toner density in the developing unit decreases, the ratio of the career in the developer increases and then an output value of the inductance sensor 112 increases. That is, the inductance sensor 112 detects the ratio of the toner in the developer accumulated in the developing unit 100 and outputs a signal in accordance with this ratio to the controller 500 (FIG. 3).

The image forming apparatus 200 is further provided with an attaching portion 20 to which the toner bottle T is attached, and a replenishment motor 120 (FIG. 3) which engages the toner bottle T, which is attached to the attaching portion 20, and drives the toner bottle T to rotate. The toner is discharged from the toner bottle T toward the developing unit 100 when the toner bottle T is driven to rotate by the replenishment motor 120 so that the amount of toner in the developing unit 100 detected by the inductance sensor 112 becomes a target amount. The toner discharged from the toner bottle T is supplied to the developing unit 100 through a conveying path 21.

Returning to FIG. 1, description on the image forming apparatus 200 will be continued. The intermediate transfer belt 7 is stretched around a secondary transfer facing roller 8, a driven roller 17 and rollers 18 and 19. The intermediate transfer belt 7 is rotated in a direction of an arrow B when the secondary transfer facing roller 8 is driven to rotate.

The image forming unit P is provided with a primary transfer roller 4 which transfers the toner image on the photoconductive drum 1 to the intermediate transfer belt 7. A primary transfer voltage is applied to the primary transfer roller 4 while the toner image formed on the photoconductive drum 1 passes through a primary transfer nip portion T1 at which the photoconductive drum 1 and the intermediate transfer belt 7 are pressed against the primary transfer roller 4. Therefore, the toner image on the photoconductive drum 1 is transferred to the intermediate transfer belt 7. The toner images formed on the photoconductive drums 1*a*, 1*b*, 1*c* and 1*d* are transferred to the intermediate transfer belt 7 in an overlapped manner. Therefore, a full color toner image is carried on the intermediate transfer belt 7. Residual toner on the photoconductive drum 1 is removed by a drum cleaner 6.

A secondary transfer roller 9 is disposed on the opposite side of the secondary transfer facing roller 8 with respect to the intermediate transfer belt 7. When the secondary transfer roller 9 presses the secondary transfer facing roller 8 and the intermediate transfer belt 7, a secondary transfer nip portion T2 is formed between the intermediate transfer belt 7 and the secondary transfer roller 9. When the intermediate transfer belt 7 is conveyed in the direction of the arrow B, the toner image on the intermediate transfer belt 7 is conveyed to the secondary transfer nip portion T2.

A conveyance roller pair 61 and a registration roller pair 62 convey a recording material S stored in a cassette portion 60 so that timing at which the toner image reaches the secondary transfer nip portion T2 and timing at which the recording material S reaches the secondary transfer nip portion T2 correspond to each other. While the toner image and the recording material S on the intermediate transfer belt 7 are passing through the secondary transfer nip portion T2, a secondary transfer voltage is applied to the secondary transfer facing roller 8. Therefore, the toner image on the intermediate transfer belt 7 is transferred to the recording material S. A belt cleaner 11 removes residual toner that has not been transferred to the recording material S in the secondary transfer nip portion T2 and remains on the intermediate transfer belt 7.

After the toner image is transferred to the recording material S by the secondary transfer roller 9, the recording material S is conveyed to a fixing unit 13. The fixing unit 13 is provided with a fixing roller which has a heater, and a pressure roller. The fixing unit 13 fixes the toner image on the recording material S to the recording material S with the heat of the heater and the pressure of the fixing roller and the pressure roller. The recording material S to which the toner image is fixed by the fixing unit 13 is discharged by a discharge roller pair 64 from the image forming apparatus 200.

Next, a toner replenishment control process in which the developing unit 100 is replenished with toner from the toner bottle T based on toner consumption consumed from the developing unit 100 when the image forming unit P forms the toner image in accordance with the image data, and based on a detection result of the inductance sensor 112, will be described.

FIG. 3 is a block diagram illustrating an electrical configuration related to toner replenishment of the image forming apparatus 200. For the ease of explanation, inside of the controller 500 is represented by blocks each corresponding to a function executed by the controller 500 in the toner replenishment control process.

A RAM 502 is system work memory used for the toner replenishment control process. Control programs for controlling the toner replenishment control process and the like are stored in a ROM 503. An I/F 504 is an interface connected to a scanner, an external PC, and the like to be communicable.

A photo-interrupter 111 is an optical sensor which outputs an ON signal when the toner bottle T is attached to the attaching portion 20 (FIG. 2) and outputs an OFF signal when no toner bottle T is attached to the attaching portion 20 (FIG. 2). Since a configuration of the photo-interrupter 111 is a publicly known configuration, description thereof will be omitted.

Here, in the present embodiment, the controller 500 stores information indicating that the toner bottle T has been replaced in accordance with a change in the output signal of the photo-interrupter 111. In particular, in response that the output signal of the photo-interrupter 111 is switched from the OFF signal to the ON signal, the controller 500 sets a bottle replacement flag to ON.

The controller 500 has different methods for determining the amount of toner to be replenished to the developing unit 100 from the toner bottle T in accordance with the state of the bottle replacement flag: ON or OFF. The method for determining the amount of toner to be replenished will be described later.

Since the inductance sensor 112 has been described with reference to FIG. 2, description thereof will be omitted. The replenishment motor 120 drives the toner bottle T attached to the attaching portion 20 to rotate.

A counter 1100 calculates the sum of a density of each pixel included in an image corresponding to a page in accordance with image data input via the I/F 504. The sum of the density of each pixel calculated by the counter 1100 (hereafter, referred to as a video count value) corresponds to toner consumption consumed from the developing unit 100 when a page of toner image included in the image data is formed. Since the method for obtaining the video count value is a publicly known technique, description thereof will be omitted.

In the present embodiment, the controller 500 determines a replenishing amount of the toner to be replenished to the developing unit 100 in accordance with an output value output from the inductance sensor 112 and the video count value obtained by the counter 1100. Each time a cumulative value of the determined replenishing amount exceeds a predetermined value, the controller 500 drives the replenishment motor 120 to rotate so as to replenish toner to the developing unit 100 from the toner bottle T.

Toner Replenishment Control

Figure 4:
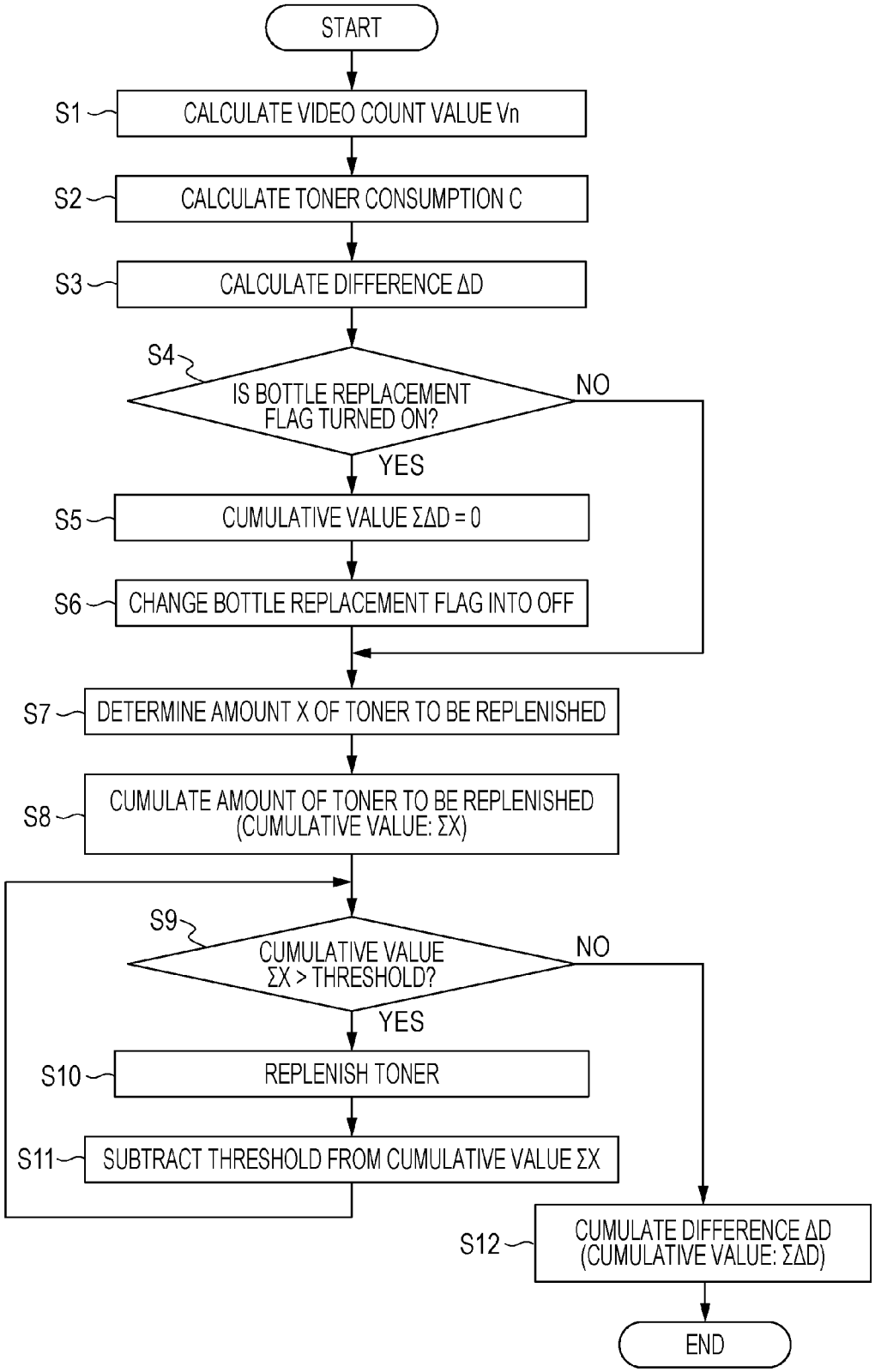
FIG. 4 is a flowchart illustrating toner replenishment control.

Hereinafter, the toner replenishment control in the present embodiment will be described with reference to FIG. 4. FIG. 4 is a flowchart illustrating an operation of the controller 500.

The controller 500 starts the toner replenishment control in response to the transfer of the image data via the I/F 504. The counter 1100 calculates a video count value Vn based on the image data (S1). In step S1, the counter 1100 obtains the video count value Vn for each page from at least one page or more of the toner image included in the image data.

In accordance with the video count value Vn calculated in step S1, a consumption calculating unit 1101 (i.e., a first determination unit) determines the toner consumption consumed from the developing unit 100 when the toner image is formed (S2). A conversion table indicating a correlation between the video count value and the toner consumption is stored in the ROM 503. In step S2, the consumption calculating unit 1101 determines toner consumption C based on the video count value Vn by referring to the conversion table stored in the ROM 503 in advance.

The consumption calculating unit 1101 outputs, to a replenishing amount calculating unit 1300 (i.e., a forth determination unit), the toner consumption C of a corresponding page in accordance with the timing at which the image forming unit P starts forming a toner image of each page. That is, the counter 1100 and the consumption calculating unit 1101 output, to the replenishing amount calculating unit 1300, the toner consumption C consumed from the developing unit 100 in accordance with a page of the toner image to be formed by the image forming unit P.

A difference calculating unit 1200 (i.e., a second determination unit) determines the amount of toner in the developing unit 100 in accordance with an output value D of the inductance sensor 112, and calculates a difference ΔD between the determined amount of toner and the target value Dref output from the target value determination unit 1201 (S3). In step S3, the difference calculating unit 1200 determines a difference ΔD equivalent to a difference between the amount of toner in the developing unit 100 and the target amount. The target value Dref is the target amount of toner in the developing unit 100. The target value Dref is determined, for example, experimentally and is stored in the ROM 503. The difference calculating unit 1200 may calculate a difference between the output value D of the inductance sensor 112 and an output target value of the inductance sensor 112. In this case, the target value determination unit 1201 determines the target value Dref of the output value of the inductance sensor 112 in accordance with the ambient temperature and humidity of the image forming apparatus 200 detected by an unillustrated environment sensor provided in the image forming apparatus 200. In a case in which the amount of toner is smaller than the target value, the difference ΔD is greater than zero and, in a case in which the amount of toner is greater than the target value, the difference ΔD is smaller than zero.

After the difference between the amount of toner in the developing unit 100 and the target amount is determined, the controller 500 determines whether the bottle replacement flag is ON (S4). In step S4, if the bottle replacement flag is ON, the controller 500 determines that the toner bottle T has been replaced and sets a value of a cumulative value ΣΔD of a difference to be calculated by a cumulative value calculating unit 1202 (i.e., a third determination unit) in step S12 described below to 0 (S5).

Here, the cumulative value ΣΔD is a value obtained by cumulating differences ΔD calculated in accordance with the output value D output from the inductance sensor 112 and the target value Dref of the output of the inductance sensor 112. That is, the cumulative value ΣΔD is equivalent to a value obtained by cumulating differences between the amount of toner accumulated in the developing unit 100 and the target amount. This cumulative value ΣΔD is a correction amount used for correcting a supply amount of toner to be supplied to the developing unit 100 from the toner bottle T in a replenishing operation of the toner bottle T that is attached to the attaching portion 20. The correction amount is a correction amount in accordance with the amount of toner contained in the toner bottle T.

Therefore, in a case in which an amount X of toner to be replenished is calculated based on a correction amount corresponding to the toner bottle T before replacement (i.e., the cumulative value ΣΔD) even after the toner bottle T has been replaced with a toner bottle T', a gap is produced in the amount X of toner to be replenished.

Then, in the present embodiment, in a case in which the controller 500 determines that the toner bottle T has been replaced in accordance with the state of the bottle replacement flag, the cumulative value calculating unit 1202 sets a value of the cumulative value ΣΔD to 0. That is, in response that the state is changed from a state in which the toner bottle T is not attached to the attaching portion 20 to a state in which the toner bottle T is attached to the attaching portion 20, the cumulative value calculating unit 1202 resets the cumulative value ΣΔD.

Next, the controller 500 changes the bottle replacement flag into OFF from ON (S6) and the replenishing amount calculating unit 1300 determines the amount X of toner to be replenished to the developing unit 100 from the toner bottle T (S7). In step S7, the replenishing amount calculating unit 1300 calculates the amount X of toner to be replenished to the developing unit 100 in accordance with the toner consumption C, the difference ΔD and the cumulative value ΣΔD.

The replenishing amount calculating unit 1300 determines the amount X of toner to be replenished in accordance with, for example, Expression (1).

$$X=(\alpha\times C)+(\beta\times\Delta D)+(\gamma\times\Sigma\Delta D) \quad (1)$$

Here, the constants α, β and γ are values of gains experimentally determined in advance. In the present embodiment, for example, the constants β and γ are positive values smaller than 1.

According to the present embodiment, since the amount X of toner to be replenished is calculated without using the cumulative value ρΔD corresponding to the toner bottle T before the replacement even after the toner bottle T is replaced with the toner bottle T', fluctuation in the amount X of toner to be replenished may be reduced.

On the other hand, if the bottle replacement flag is OFF in step S4, the replenishing amount calculating unit 1300 determines, in step S7, the amount X of toner to be replenished using the cumulative value ΣΔD calculated in a period after the toner bottle T is replaced and before the step S7 is executed. Therefore, since the amount of toner to be replenished in accordance with the cumulative value ΣΔD corresponding to the toner bottle T is calculated, the controller 500 may determine the amount X of toner to be replenished with high accuracy.

Here, in the present embodiment, a replenishing system to replenish the toner to the developing unit 100 from the toner bottle T has a configuration in which a substantially fixed amount of toner is replenished to the developing unit 100 from the toner bottle T by rotating the toner bottle T 360 degrees. Therefore, if the cumulative value ΣX of the amount of toner to be replenished is equal to or smaller than a threshold, the controller 500 does not perform the replenishing operation by the toner bottle T and, if the cumulative value ΣX of the amount of toner to be replenished exceeds a threshold, the controller 500 rotates the toner bottle T to perform the replenishing operation. The threshold may be suitably determined by measuring the amount of toner replenished to the developing unit 100 from the toner bottle T experimentally in advance when the toner bottle T is rotated 360 degrees, and setting in accordance with the measurement result. In the present embodiment, the threshold is set to 80% of the replenishing amount per unit rotation amount in a case in which, for example, the amount of toner replenished to the developing unit 100 from the toner bottle T is set to 100% when the toner bottle T is rotated 360 degrees (i.e., the replenishing amount per unit rotation amount). The value of the threshold is stored in the ROM 503 in advance.

The replenishing amount calculating unit 1300 calculates the cumulative value ΣX of the amount X of toner to be replenished (S8) and determines whether the cumulative value ΣX is greater than the threshold (S9). If it is not determined that the cumulative value ΣX is greater than the threshold in step S9, that is, if the cumulative value ΣX is equal to or smaller than the threshold, the cumulative value calculating unit 1202 adds the difference ΔD to the cumulative value ΣΔD (S12) and the toner replenishment control process is completed. If the toner bottle T is not replaced, the cumulative value ΣΔD updated in step S12 is used for the calculation for determining the amount X of toner to be replenished when the next toner replenishment control process is performed.

On the other hand, if the cumulative value ΣX is greater than the threshold in step S9, the controller 500 drives the replenishment motor 120 to rotate the toner bottle T 360 degrees to replenish toner to the developing unit 100 from the toner bottle T (S10). The replenishing amount calculating unit 1300 then subtracts the threshold from the cumulative value ΣX (S11) and the controller 500 proceeds to process to step S9. In step S11, since the toner is replenished to the developing unit 100 from the toner bottle T when the toner bottle T is rotated 360 degrees, the replenishing amount calculating unit 1300 subtracts the threshold from the cumulative value ΣX to calculate how much amount of toner to be replenished to the developing unit 100 remains. In the processes from step S9 to step S11, the controller 500 supplies toner to the developing unit 100 from the toner bottle T at a time or at a plurality of times until the cumulative value ΣX becomes smaller than the threshold.

Comparison of Effects

Figure 5:
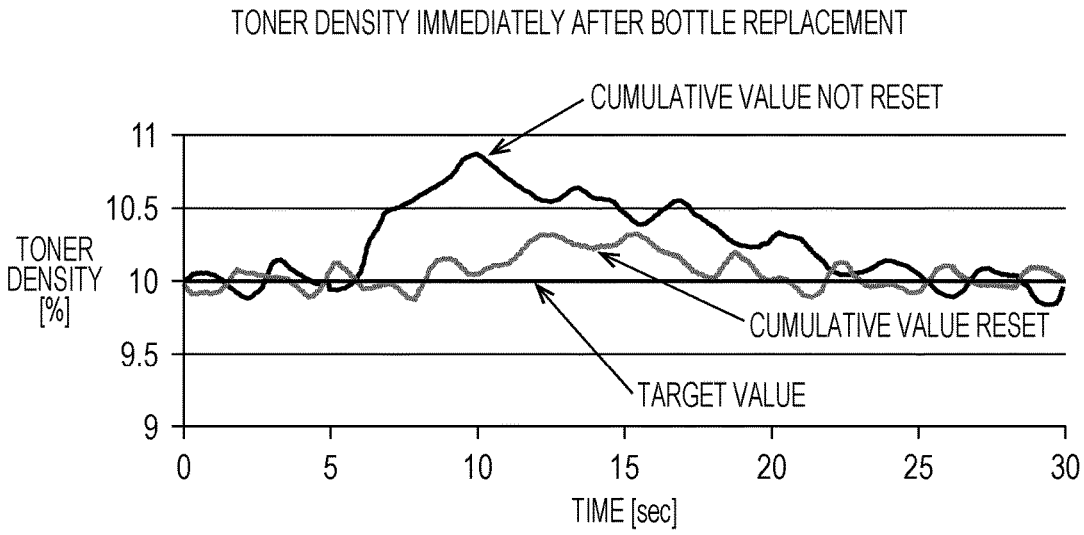
FIG. 5 is a diagram illustrating a toner density after a toner bottle is replaced.

Hereinafter, a result of comparison of effects between a configuration in which the cumulative value ρΔD before replacement is reset in a case in which the toner bottle T is replaced and a configuration in which the cumulative value ΣΔD before the replacement is used in a case in which the toner bottle T is replaced will be described. FIG. 5 illustrates an experimentally obtained result of transition of toner density in the developing unit in the configuration in which the cumulative value ΣΔD is reset in a case in which the toner bottle T is replaced (i.e., the present embodiment) and the configuration in which the cumulative value ΣΔD before replacement is used in a case in which the toner bottle T is replaced (i.e., Comparative Example). In FIG. 5, it is supposed that the ideal toner density in the developing unit is a case in which a ratio of mass of toner in the developer is 10%. FIG. 5 illustrates the toner density in the developing unit when a toner image is continuously formed in a period from immediately after the toner bottle T is replaced at time 0 sec.

In the configuration in which the cumulative value ΣΔD before replacement is used in a case in which the toner bottle T is replaced, deviation of the toner density in the developing unit from a target value is as large as 0.8% during a period from 6 sec to 23 sec after the toner bottle T is replaced. On the other hand, in the configuration in which the cumulative value ΣΔD is reset in a case in which the toner bottle T is replaced, deviation of the toner density in the developing unit is equal to or lower than 0.3% during a period until 30 sec elapses after the replacement of the toner bottle T.

Therefore, since the fluctuation in the toner density in the developing unit may be reduced by setting the cumulative value ΣΔD to 0 in a case in which the toner bottle T is replaced, the density of the toner image formed by the image forming unit P may be stabilized.

Further, in the present embodiment, in a case in which it is detected that the toner bottle T has been replaced, the cumulative value calculating unit 1202 changes the value of the cumulative value ΣΔD into 0. Alternatively, however, the value of the cumulative value ΣΔD may be changed into a predetermined value other than 0.

For example, the cumulative value calculating unit 1202 may change the value of the cumulative value ΣΔD into a negative value in a case in which it is detected that the toner bottle T has been replaced. An experiment shows in advance that, in a case in which a toner bottle T containing a large amount of toner is attached to the attaching portion 20, an amount of toner replenished to the developing unit 100 from this toner bottle T becomes very large when this toner bottle T is rotated 360 degrees. Therefore, it is possible to prevent the toner density in the developing unit from deviating significantly from the target value when the toner is replenished to the developing unit 100 from this toner bottle T by setting the value of the cumulative value ΣΔD to a negative value.

Although the cumulative value calculating unit 1202 sets the cumulative value ΣΔD to 0 in the present embodiment, it is also possible that the replenishing amount calculating unit 1300 determines the amount X of toner to be replenished in accordance with the toner consumption C and the difference ΔD without using the value of the cumulative value ρΔD.

In the present embodiment, each time the image data corresponding to a page of recording material is transferred to the controller 500 via the I/F 504, the controller 500 controls the amount of toner to be replenished and, if the value of the cumulative value ΣX exceeds the threshold before the image forming unit P forms a page of recording material of toner image, the toner is replenished. However, the timing at which the controller 500 performs the toner replenishment control process is not limited to this configuration.

For example, while an agitation screw which agitates the toner accumulated in the developing unit 100 is rotating, the controller 500 may perform the toner replenishment control process of FIG. 4 at predetermined time intervals. With this configuration, since the toner can be replenished to the developing unit 100 from the toner bottle T each time the toner density in the developing unit becomes smaller than the target value, the density of the toner image formed by the image forming unit P may further be stabilized.

According to the toner replenishment control of the present embodiment, in a case in which the toner bottle T is replaced, the amount of toner to be replenished to the developing unit is controllable with high accuracy.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-260380, filed Dec. 17, 2013 which is hereby incorporated by reference herein in its entirety.

What is claimed is:

1. An image forming apparatus comprising:

a latent image forming unit configured to form an electrostatic latent image on an image carrier based on image data;

a development unit configured to develop the electrostatic latent image using a developer including a toner;

a measurement unit configured to measure a toner density of the developer in the development unit;

a portion to which a container is mountable, the container containing a toner;

a replenishment unit configured to replenish toner in the development unit from the container mounted to the portion; and a controller configured to determine a first value corresponding to an amount of toner consumed from the development unit based on the image data, determine a second value corresponding to a difference between the toner density measured by the measurement unit and a target toner density, determine a third value by accumulating the second value, determine an amount of toner to be replenished in the development unit based on the first value, the second value and the third value, determine a cumulative value by accumulating the amount of toner, and control the replenishment unit based on the cumulative value, wherein in a case where the container is exchanged with another container, the controller changes the third value into a predetermined value without changing the cumulative value into the predetermined value.

2. The image forming apparatus according to claim 1, wherein the controller prohibits the replenishment unit from replenishing the toner from the container to the development unit in a case where the cumulative value does not exceed a threshold amount.

3. The image forming apparatus according to claim 2, wherein the replenishment unit replenishes the toner in the development unit from the container by rotating the container, the controller controls an amount of rotation of the container by the replenishment unit based on the cumulative value, the controller decreases the cumulative value based on the amount of rotation of the container, and the controller controls the amount of rotation of the container so that the cumulative value is smaller than the threshold value.

4. The image forming apparatus according to claim 3, wherein the threshold value is determined in advance based on the amount of toner to be replenished in the development unit from the container in a case where the container is rotated a predetermined amount by the replenishment unit, and the controller decreases, by the threshold value, the cumulative value each time an amount of rotation of the container by the replenishment unit becomes a predetermined amount of rotation.

5. The image forming apparatus according to claim 1, wherein the controller determines the cumulative value each time the image forming apparatus forms an image corresponding to a page of a recording material.

6. The image forming apparatus according to claim 1, wherein the development unit is provided with an agitation unit configured to agitate the developer accumulated in the development unit, and the controller determines the cumulative value at predetermined time intervals while the agitation unit agitates the developer.

7. The image forming apparatus according to claim 1, wherein the predetermined value is 0.

8. The image forming apparatus according to claim 1, wherein the controller changes the third value into the predetermined value after the container is exchanged with the another container.

9. The image forming apparatus according to claim 1, wherein the controller changes the third value into the predetermined value in a period from a first timing that the container is exchanged with the another container until a second timing that the second value is newly determined by the controller.

10. A control method of an image forming apparatus which includes an image carrier, a latent image forming unit configured to form an electrostatic latent image on the image carrier based on image data, a development unit configured to develop the electrostatic latent image using a developer including a toner, a detection unit configured to detect an amount of the toner in the development unit, a portion to which a container is mountable, the container containing a toner, and a replenishment unit configured to replenish toner to the development unit from the container on which the portion is mounted, the control method comprising:

determining a first value based on the image data, the first value being corresponded to an amount of toner consumed from the development unit for forming an image;

determining a second value, the second value being corresponded to a difference between the amount of the toner detected by the detection unit and a target amount of the toner;

determining a third value by accumulating the second value;

determining an amount of toner to be replenished to the development unit based on the first value, the second value and the third value;

determining a cumulative value by accumulating the amount of toner;

controlling the replenishment unit based on the cumulative value; and setting, in a case where the container is exchanged with another container, the third value as a predetermined value without changing the cumulative value into the predetermined value.

11. The control method of the image forming apparatus according to claim 10, further comprising:

prohibiting the replenishment unit from replenishing the toner from the container in the development unit in a case where the cumulative value does not exceed a threshold value.

12. The control method of the image forming apparatus according to claim 11, further comprising:

rotating the container;

controlling an amount of rotation of the container based on the cumulative value;

decreasing the cumulative value based on the amount of rotation; and controlling the amount of rotation so that the cumulative value is smaller than the threshold value.

13. The control method of the image forming apparatus according to claim 12, further comprising:

determining the threshold value in advance based on the amount of toner to be replenished in the development unit from the container in a case where the container is rotated a predetermined amount by the replenishment unit, and decreasing, by the threshold value, the cumulative value each time an amount of rotation of the container by the replenishment unit becomes a predetermined amount of rotation.

14. The control method of the image forming apparatus according to claim 10, further comprising determining the cumulative value each time the image forming apparatus forms an image corresponding to a page of a recording material.

15. The control method of the image forming apparatus according to claim 10, further comprising:

agitating the developer accumulated in the development unit; and determining the cumulative value at predetermined time intervals while the agitating agitates the developer.

16. The control method of the image forming apparatus according to claim 10, wherein the predetermined value is 0.

17. The control method of the image forming apparatus according to claim 10, wherein the third value is set as the predetermined value after the container is exchanged with the another container.

18. The control method of the image forming apparatus according to claim 10, wherein the third value is set as the predetermined value in a period from a first timing that the container is exchanged with the another container until a second timing that the second value is newly determined.

* * * * *